US009832558B2

(12) United States Patent
Smith

(10) Patent No.: US 9,832,558 B2
(45) Date of Patent: Nov. 28, 2017

(54) ANTI-SHOCK SELF-POWERED MICROPHONE AND MONITOR SYSTEM FOR WIND INSTRUMENTS AND A MOUNT THEREFOR

(71) Applicant: Robert Carroll Smith, Escondido, CA (US)

(72) Inventor: Robert Carroll Smith, Escondido, CA (US)

(73) Assignee: Robert Carroll Smith, Escondido, CA (US)

( * ) Notice: Subject to any disclaimer, the term of this patent is extended or adjusted under 35 U.S.C. 154(b) by 0 days.

(21) Appl. No.: 15/404,621

(22) Filed: Jan. 12, 2017

(65) Prior Publication Data

US 2017/0201818 A1 Jul. 13, 2017

Related U.S. Application Data

(60) Provisional application No. 62/277,856, filed on Jan. 12, 2016.

(51) Int. Cl.
*H04R 1/08* (2006.01)
*H04R 29/00* (2006.01)

(52) U.S. Cl.
CPC ..... *H04R 1/08* (2013.01); *H04R 29/004* (2013.01); *H04R 2420/07* (2013.01); *H04R 2420/09* (2013.01); *H04R 2430/01* (2013.01)

(58) Field of Classification Search
CPC .... H04R 1/08; H04R 29/004; H04R 2420/07; H04R 2420/09; H04R 2430/01
See application file for complete search history.

(56) References Cited

U.S. PATENT DOCUMENTS 3,482,026 A * 12/1969 Babicky ..... G10D 9/00 381/118
3,510,564 A * 5/1970 Wetsell ..... G10D 9/00 84/723
3,593,145 A * 7/1971 Valley ..... G10D 9/00 381/118

(Continued)

FOREIGN PATENT DOCUMENTS

CN 203165436 U * 8/2013
EP 0423858 A2 * 4/1991 ..... G10D 9/00

(Continued)

*Primary Examiner* — Brenda Bernardi
(74) *Attorney, Agent, or Firm* — MKG, LLC

(57) ABSTRACT

An anti-shock self-powered microphone and monitor system for wind or brass instruments includes a mounting basket and mounting ring, a microphone and microphone mount disposed within the mounting ring, and a wired or wireless personal monitor connected to the microphone. One filament fastens the microphone within the mounting ring by engaging a mounting ring coupling attached to the mounting ring and the microphone mount. Another filament fastens the mounting ring coupling to a bell mounting coupling thereby providing for removeably attaching the system to a bell of a wind or brass instrument. The mounting basket is adaptable in size to accommodate the attachment of the mounting basket to the bell of a saxophone, trumpet, a plurality of brass instruments a wide array of instruments such as, for example the bell of a clarinet, a saxophone, a trumpet, a trombone, a tuba and a sousaphone.

11 Claims, 12 Drawing Sheets

(56) References Cited

U.S. PATENT DOCUMENTS

| | | | | | |
|---|---|---|---|---|---|
| 6,149,114 | A * | 11/2000 | Epping | H04R 1/08 | 248/220.22 |
| 6,757,400 | B1 * | 6/2004 | Cheng | H04R 1/08 | 381/361 |
| 7,895,925 | B2 * | 3/2011 | Chang | F16B 2/10 | 269/3 |
| 8,194,893 | B1 * | 6/2012 | Lewis | H03G 3/3005 | 381/118 |
| 8,553,896 | B2 * | 10/2013 | Dietz | H04R 5/027 | 381/118 |
| 2003/0196542 | A1 * | 10/2003 | Harrison, Jr. | G04B 25/00 | 84/737 |
| 2015/0373437 | A1 * | 12/2015 | Chiang | H04R 1/08 | 381/91 |
| 2016/0112786 | A1 * | 4/2016 | Murata | H04R 1/08 | 248/231.51 |

FOREIGN PATENT DOCUMENTS

| | | | | |
|---|---|---|---|---|
| NL | 1002486 | C1 * | 4/1997 | G10D 9/00 |
| WO | WO 9404009 | A1 * | 2/1994 | G10H 3/14 |

* cited by examiner

ANTI-SHOCK SELF-POWERED MICROPHONE AND MONITOR SYSTEM FOR WIND INSTRUMENTS AND A MOUNT THEREFOR

CROSS-REFERENCE TO RELATED APPLICATIONS

This application claims the benefit of U.S. Provisional Patent Application No. 62/277,856 filed on Jan. 12, 2016, which is incorporated herein by reference in its entirety.

TECHNICAL FIELD

The present invention is directed to providing an anti-shock self-powered microphone and monitor system for wind or brass instruments and a mount for the microphone on the instrument.

BACKGROUND

In the music industry, microphones are primarily used to record or amplify sound such as for example, for studio recording or during a live performance. Condenser microphones are typically used for studio recording because they are very sensitive; however, condenser microphones typically require an external power source. Dynamic microphones are typically used for live performances because they are durable and can be tailored for certain frequencies for specialized applications.

The sound pickup of a microphone is dependent upon the mic's polar pattern. For example, a cardioid microphone generally picks up sound emanating from in front of it with very little from the side and nothing from the back. Cardioid microphones are often used for a singer or a single instrument. In contrast, an omnidirectional microphone picks up sound emanating from a 360-degree radius. Omnidirectional microphones are often used to capture a multitude of sounds mixed with a particular sound source or when the sound source is changing position in relation to the microphone.

Microphones are typically connected to a sound system component such as a soundboard or amplifier via a cable and jack assembly. Some microphones used for simple home recording can be connected to a computer via a Universal Serial Bus ("USB") port. Wireless microphones are often used by a singer that desires to roam the stage during a performance. The wireless microphone uses battery power to transmit a signal to a receiver that is typically connected to a mixing board like a wired microphone.

The sensitivity of a microphone relates to how the microphone responds to changing air pressure. Highly sensitive microphones are often used when high sonic detail is desirable such as when recording an acoustic guitar and capturing the sound of fingertips sliding across the strings. In contrast, lower sensitive microphones are often used when less sonic detail is desirable such as when set in front of a bass drum during a live performance. Setting a microphone in close proximity to an instrument, or mounting a microphone to the instrument, is often considered to be a compromise of the instrument's true acoustic sound in deference to the purpose of using the microphone (i.e., recording or amplifying the sound of the instrument). An instrument's sound is typically designed to be experienced at a distance from the instrument such that all the different elements of the sound are naturally blended into a perfect harmony. However, mounting a microphone directly on the instrument is the most practical solution.

Finding and placing a microphone in the instrument's preferred location, or its sweet spot, is a challenge, particularly for a wind instrument such as a saxophone, trumpet, and the like, especially if the musician is moving as during a live performance. Horn instruments such as saxophones radiate sound from the tone holes as well as from the bell. The most natural sound pickup is achieved if the microphone captures a balanced mixture of the sounds radiated from these sources. Attaching the microphone directly on the saxophone gives the player freedom to move but also limits the sound picked up by microphone and thus compromises the instrument's true acoustic sound. In addition, the actual mount employed to attach the microphone to the instrument, such as a clip or other hard mount, introduces unwanted vibration and other tone-altering effects to the sound picked up the mounted microphone.

What is needed is an anti-shock self-powered microphone and monitor for wind instruments and a mount for the microphone on the wind instrument. A need exists for a lightweight, self-powered and self-contained personal monitor and anti-shock mounted microphone designed specifically for a wind instrument.

SUMMARY

In one aspect, the present invention resides in an anti-shock self-powered microphone and monitor system for wind or brass instruments, the system comprising: a mounting basket including a mounting ring; a microphone, a portion of which defines a microphone mount, disposed within the mounting ring; a personal monitor; a cable extending between and connecting the mounting basket and the personal monitor; at least one first filament fastening the microphone within the mounting ring, the at least one first filament engaging at least one mounting ring coupling attached to the mounting ring, the at least one first filament further engaging the microphone mount; and at least one second filament fastening the at least one mounting ring coupling to a corresponding at least one bell mounting coupling thereby providing for removeably attaching the system to a bell of a wind or brass instrument.

In one aspect, the present invention resides in an anti-shock self-powered microphone and monitor system for wind or brass instruments, the system comprising: a mounting basket including a mounting ring; a microphone, a portion of which defines a microphone mount, disposed within the mounting ring; a personal monitor configured as a hard-wired device, the personal monitor comprising, a housing, a first audio input, a first audio output port, a first audio output power switch and volume control, a first audio output power indicator, a USB port for charging a battery mounted within the housing, a state-of charge indicator, a microphone impedance switch, a microphone gain switch and adjustment control, and an electrical and audio connection port; a cable extending between and connecting the mounting basket and the personal monitor; at least one first filament fastening the microphone within the mounting ring, the at least one first filament engaging at least one mounting ring coupling attached to the mounting ring, the at least one first filament further engaging the microphone mount; and at least one second filament fastening the at least one mounting ring coupling to a corresponding at least one bell mounting coupling thereby providing for removeably attaching the system to a bell of a wind or brass instrument; wherein the mounting basket is adaptable in size to accommodate the attachment of the mounting basket to a bell of a plurality of brass instruments a wide array of instruments such as, for example the bell of a clarinet, a saxophone, a trumpet, a trombone, a tuba and a sousaphone.

In one aspect, the present invention resides in an anti-shock self-powered microphone and monitor system for wind or brass instruments, the system comprising: a mounting basket including a mounting ring; a microphone, a portion of which defines a microphone mount, disposed within the mounting ring; a personal monitor configured as a wireless device, the personal monitor comprising, a housing, a first audio input, a first audio output port, a first audio output power switch and volume control, a first audio output power indicator, a USB port for charging a battery mounted within the housing, a state-of charge indicator, a transmitter mounted within the housing for transmitting a signal incorporating sounds picked up by the microphone to a soundboard, a mixing board, or to a computing device, and an antenna mounted to the housing; a cable extending between and connecting the mounting basket and the personal monitor; at least one first filament fastening the microphone within the mounting ring, the at least one first filament engaging at least one mounting ring coupling attached to the mounting ring, the at least one first filament further engaging the microphone mount; and at least one second filament fastening the at least one mounting ring coupling to a corresponding at least one bell mounting coupling thereby providing for removeably attaching the system to a bell of a wind or brass instrument; wherein the mounting basket is adaptable in size to accommodate the attachment of the mounting basket to a bell of a plurality of brass instruments a wide array of instruments such as, for example the bell of a clarinet, a saxophone, a trumpet, a trombone, a tuba and a sousaphone.

DETAILED DESCRIPTION

The present invention provides is an anti-shock self-powered microphone and monitor system for wind or brass instruments and a mount for the microphone on the wind instrument, referred to herein as a "Soundcatcher." The device is a lightweight, self-powered and self-contained personal monitor and anti-shock mounted microphone designed specifically for capturing or picking up the sound emanating from the sweet spot of the instrument. The Soundcatcher is a powerful and versatile tool that gives a user or musician many capabilities in one device. For example, a musician now can utilize the Soundcatcher to compete in the modern amplified performing environment wherein loud drums, guitar amplifiers and keyboard arrays can be filtered out of the musician's personal as desired at the simple touch of the finger and then passed to the Soundcatcher's personal in-line headphone monitor. For example, amplifiers, auxiliary inputs and control potentiometers in the lightweight, self-powered and self-contained personal monitor and thereby enable the musician to control and adjust the mixture of the sounds and the sound signals passing through the device.

The Soundcatcher includes a plurality of features combined into the lightweight, self-powered and self-contained personal device. Previously, these individual features were available only as features of separate and comparatively bulky devices. Instead, the Soundcatcher enables a performing musician to readily and instantaneously control the sound emanating from the instrument with ease and comfort. As a result, the musician is no longer compelled to exasperatingly blow into the instrument turning red in the face all night long simply to be heard. Instead, the musician can play the music as intended with the expression of air passed into the instrument while comfortably utilizing breath control for optimum intonation.

Figure 1:
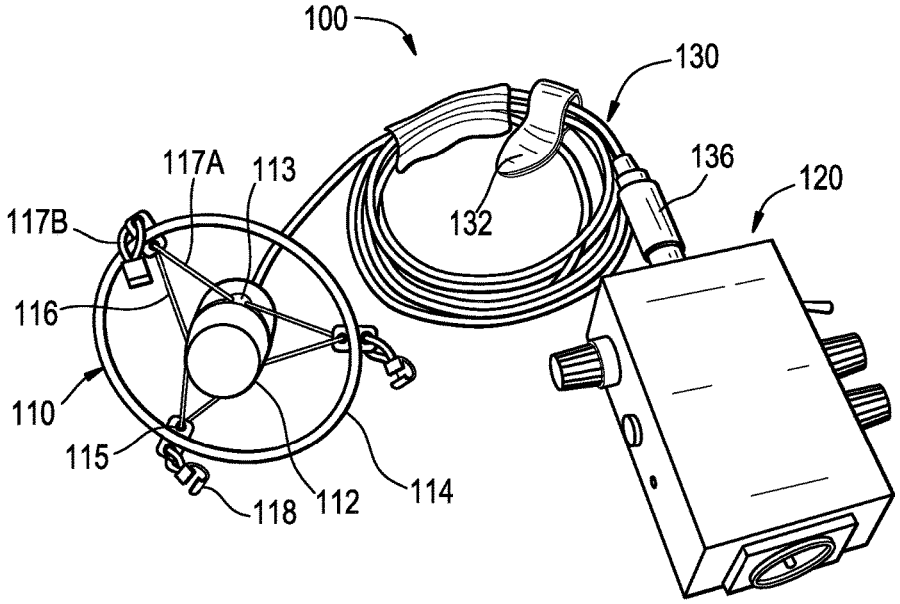
FIG. 1 is an image of one embodiment of an anti-shock self-powered microphone and monitor system for wind or brass instruments and a mount for the microphone on the instrument in accordance with the present invention.
Figure 2:
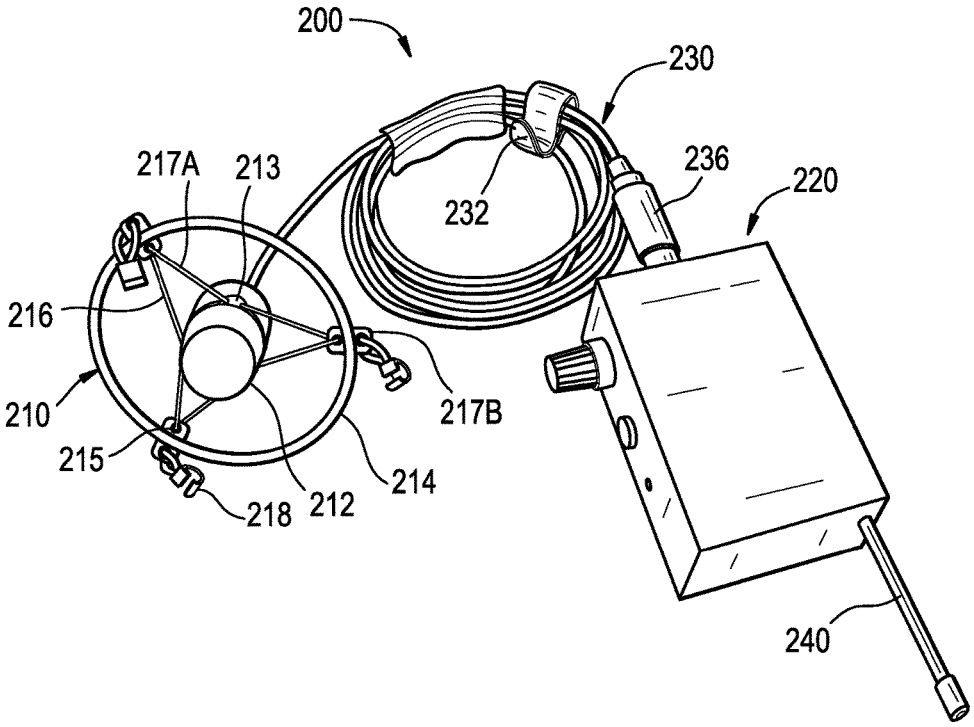
FIG. 2 is an image of another embodiment of an anti-shock self-powered microphone and monitor system for wind or brass instruments and a mount for the microphone on the instrument in accordance with the present invention.
Figure 10:
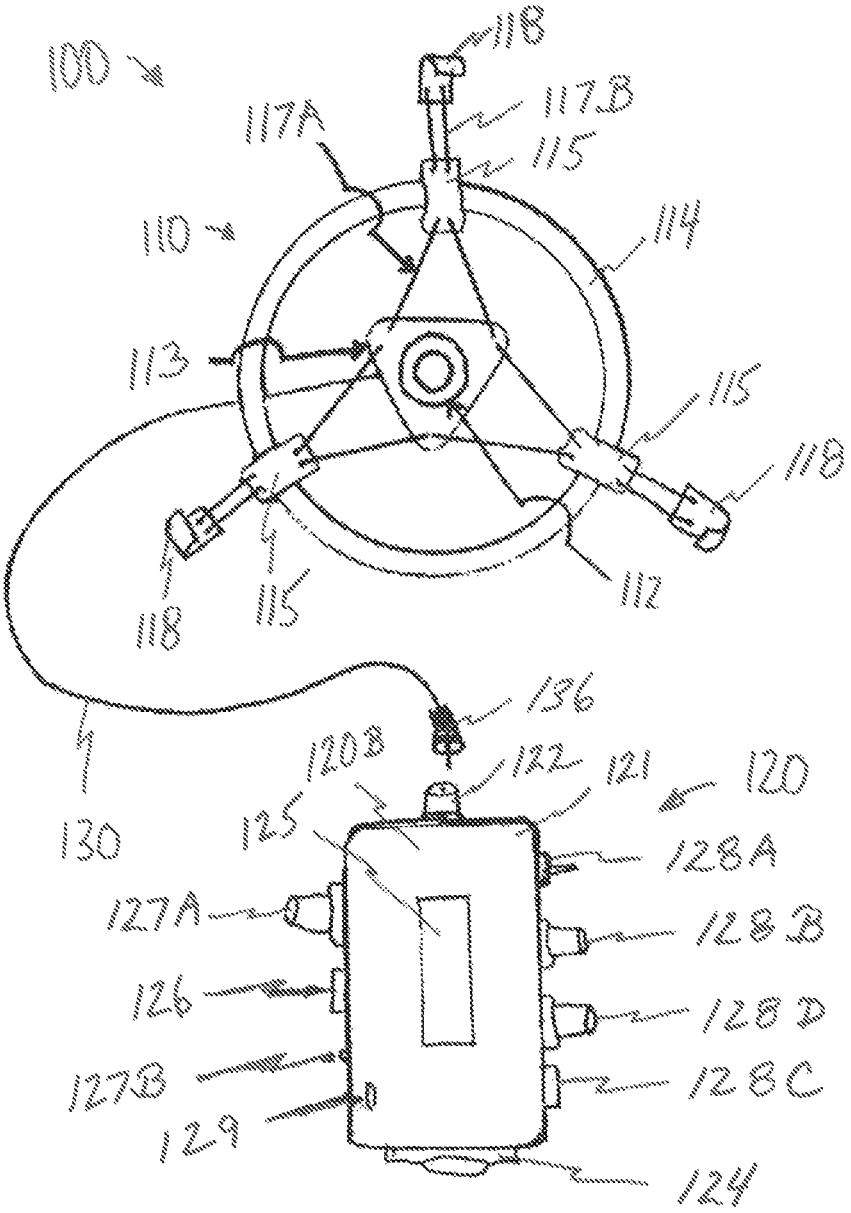
FIG. 10 is a top view of the anti-shock self-powered microphone and monitor of FIG. 1.
Figure 11:
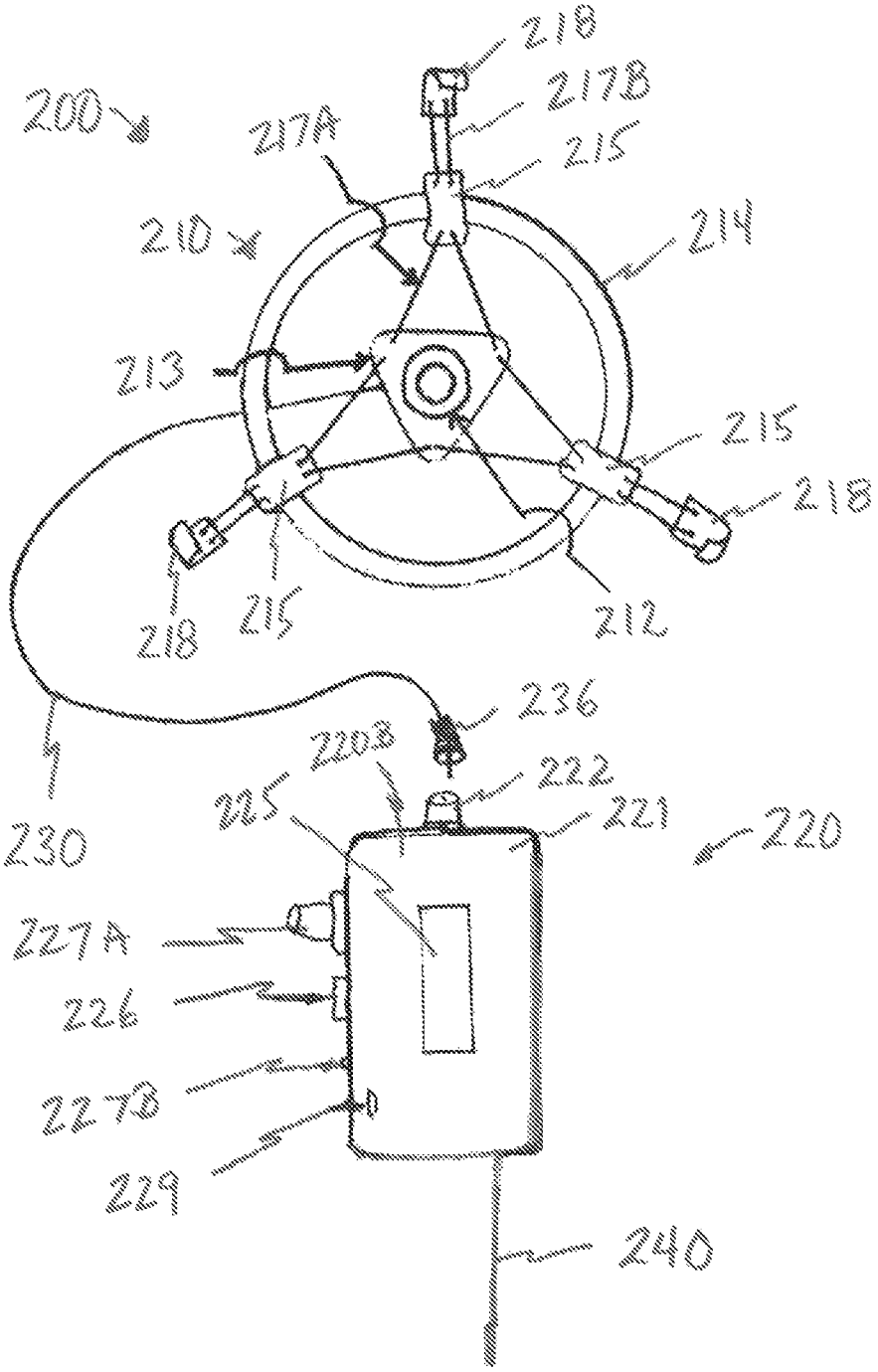
FIG. 11 is a top view of the anti-shock self-powered microphone and monitor of FIG. 2.

One embodiment of an anti-shock self-powered microphone and monitor system for wind or brass instruments and a mount for the microphone on the instrument in accordance with the present invention is shown in FIGS. 1 and 10, and is referred to herein as a Soundcatcher 100. Another embodiment of an anti-shock self-powered microphone and monitor system for wind or brass instruments and a mount for the microphone on the instrument in accordance with the present invention is shown in FIGS. 2 and 11, and is referred to herein as a Soundcatcher 200. Soundcatcher 100 is a hard-wired device configured to be connected to, or plugged into, a soundboard or mixing board as for studio recording. Soundcatcher 200 is a wireless device configured to transmit a signal to a receiver that is integral with the soundboard or mixing board as for live performances, or to a computing device for recording and/or processing the sound picked up by the Soundcatcher 200. Both Soundcatcher 100 and 200 are configured to be connected to a USB port of a computing device for recording and/or processing the sound picked up by the Soundcatcher 100, 200.

Soundcatcher 100 includes a mount or mounting basket 110, a personal monitor 120, and cable or sound cable 130 extending therebetween. The mounting basket 110 includes a microphone 112, a portion of which defines a microphone mount 113, disposed within or suspended from a mounting ring 114 and fastened or secured thereto via one or more hanging filaments 116. In one embodiment and as shown in FIG. 1, the hanging filament 116 is a first filament 117A that engages or slidingly passes through one or more mounting ring couplings 115, for example three couplings 115, fixedly or slideably mountable to mounting ring 114. The first filament 117A also engages or slidingly passes through the microphone mount 113 between each pair of mounting ring couplings 115. A second filament 117B extends through each of the mounting ring couplings 115 and passes through a corresponding bell mounting coupling 118, thereby fastening the bell mounting coupling 118 to the mounting ring couplings 115, and providing for removeably attaching the Soundcatcher 100 to a bell of a wind or brass instrument. The sound cable 130 connects the microphone 112 to the personal monitor 120 via a cable jack 136, and optionally includes a clamp 132 mountable to the musician's clothing or the like.

Soundcatcher 200 includes a mount or mounting basket 210, a personal monitor 220, and cable or sound cable 230 extending therebetween. The mounting basket 210 includes a microphone 212, a portion of which defines a microphone mount 213, disposed within or suspended from a mounting ring 214 and fastened or secured thereto via one or more hanging filaments 216. In one embodiment and as shown in FIG. 2, the hanging filament 216 is a first filament 217A that engages or slidingly passes through one or more mounting ring couplings 215, for example three couplings 215, fixedly or slideably mountable to mounting ring 214. The first filament 217A also engages or slidingly passes through the microphone mount 213 between each pair of mounting ring couplings 215. A second filament 217B extends through each of the mounting ring couplings 215 and passes through a corresponding bell mounting coupling 218, thereby fastening the bell mounting coupling 218 to the mounting ring couplings 215, and providing for removeably attaching the Soundcatcher 200 to the bell of the wind or brass instrument. The sound cable 230 connects the microphone 212 to the personal monitor 220 via a cable jack 236, and optionally includes a clamp 232 mountable to the musician's clothing or the like. An antenna 240 is mounted to the personal monitor 220.

Figure 3A:
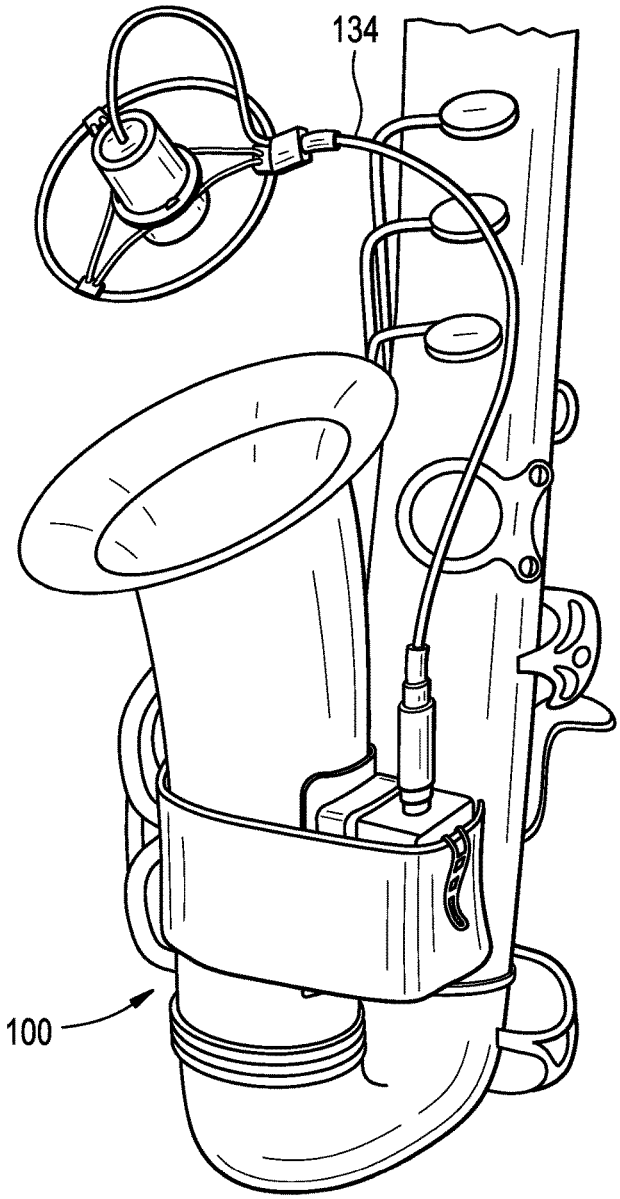
FIG. 3A is an image of one embodiment of an anti-shock self-powered microphone and monitor system mounted on a saxophone in accordance with the present invention.
Figure 3B:
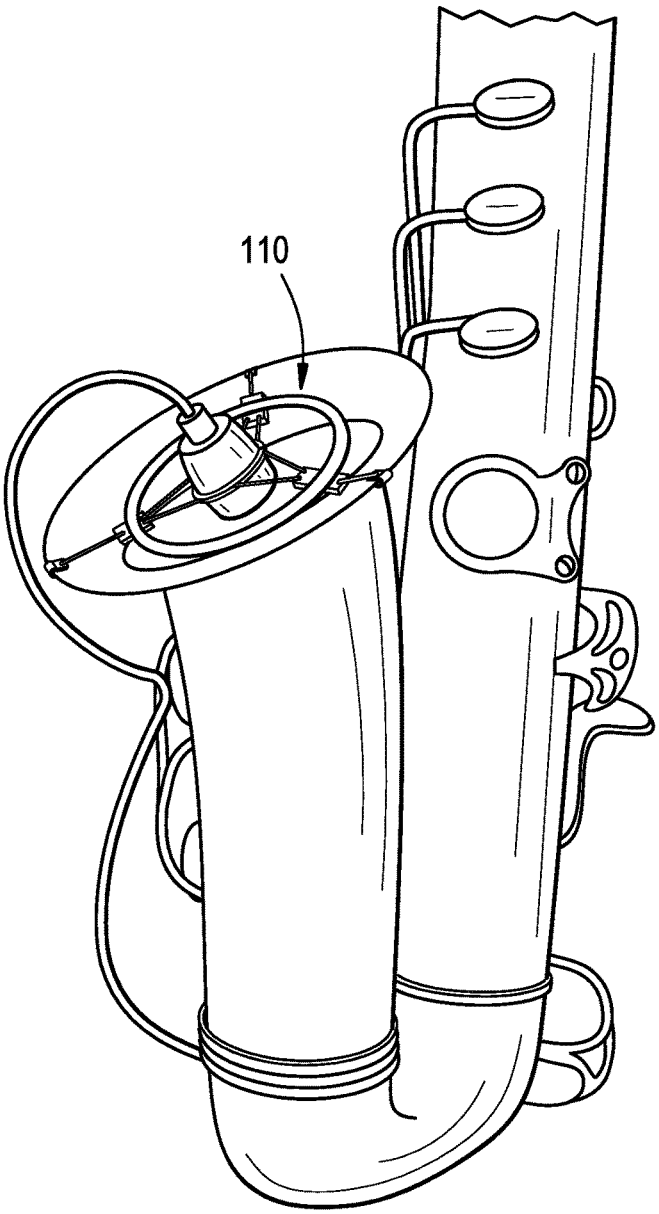
FIG. 3B is an image of another embodiment of an anti-shock microphone mounted on a saxophone in accordance with the present invention.
Figure 4:
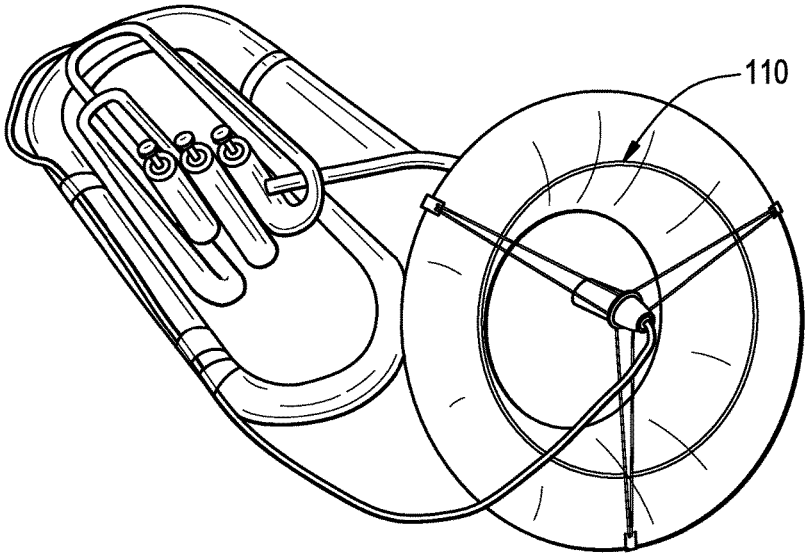
FIG. 4 is an image of one embodiment of an anti-shock self-powered microphone mounted on a tuba in accordance with the present invention.
Figure 5A:
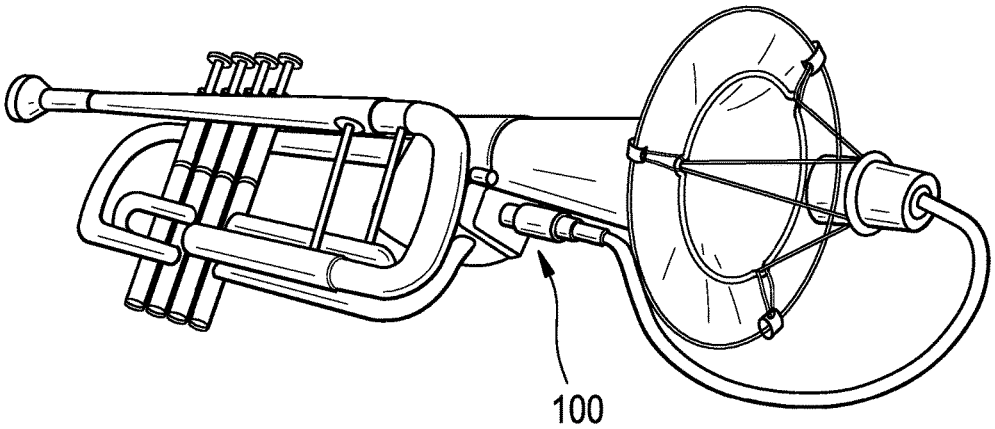
FIG. 5A is an image of one embodiment of an anti-shock self-powered microphone and monitor system mounted on a trumpet in accordance with the present invention.
Figure 5B:
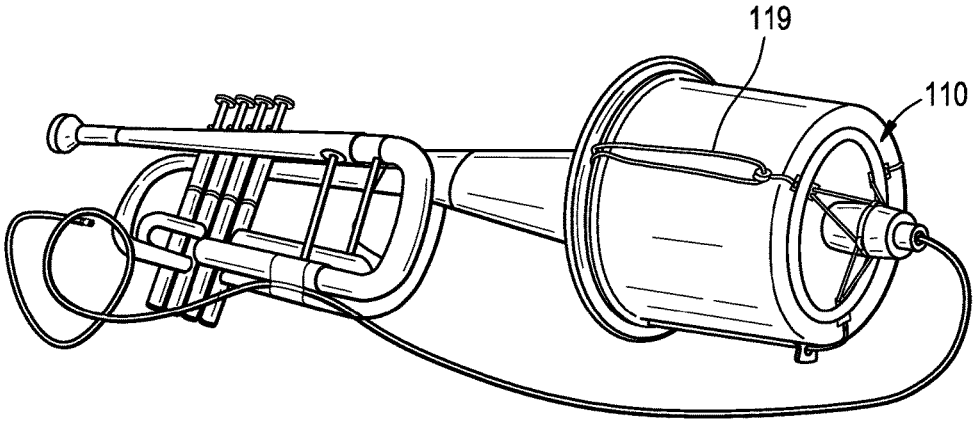
FIG. 5B is an image of one embodiment of an anti-shock self-powered microphone mounted on a trumpet having a mute disposed in the bell thereof in accordance with the present invention.
Figure 5C:
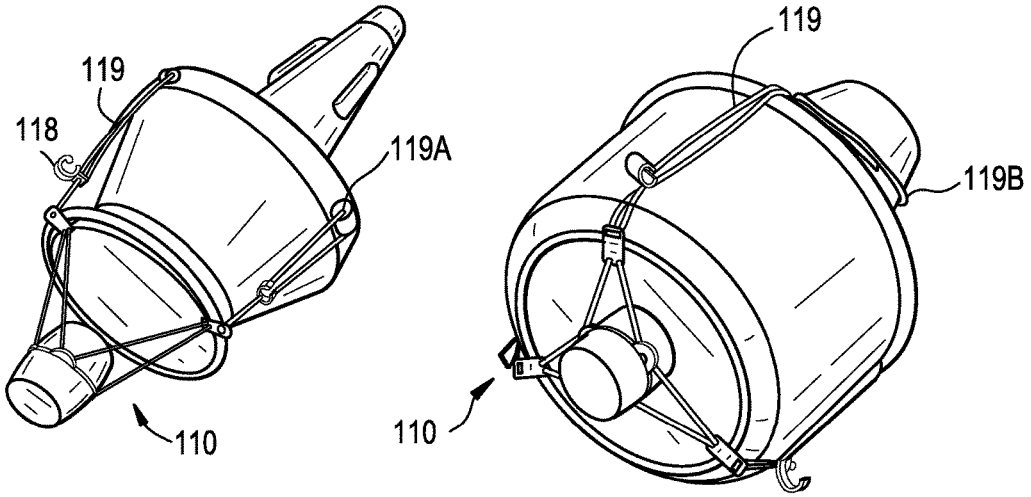
FIG. 5C is a detail image of alternate embodiments of an anti-shock microphone mounted on a mute for a trumpet in accordance with the present invention.

In one embodiment and as shown in FIG. 3A, the Soundcatcher 100 is mounted to a saxophone. In one embodiment and as further shown in FIG. 3A, the sound cable 130 is enclosed within a flexible gooseneck sheath 134 and positioned to pick up sound emanating therefrom as for studio recording. In one embodiment and as shown in FIG. 3B, the mounting basket 110 is shown mounted to the bell of a saxophone as for a live performance. The mounting basket 110 is adaptable in size to accommodate the attachment of the mounting basket 10 to a wide array of instruments such as, for example the bell of a clarinet, a saxophone, a trumpet, a trombone, a tuba as shown in FIG. 4, and even to the bell of a sousaphone. In one embodiment and as shown in FIG. 5A, the Soundcatcher 100 is mounted a trumpet. In one embodiment and as shown in FIGS. 5B and 5C, the mounting basket 110 is shown mounted to a mute that is slideably engages the bell of the trumpet, wherein one or more extension filaments 119 extend from the bell mounting couplings 118 to one of extensions couplings 119A or a mute mounting ring 119B removeably mountable to the mute.

Figure 6A:
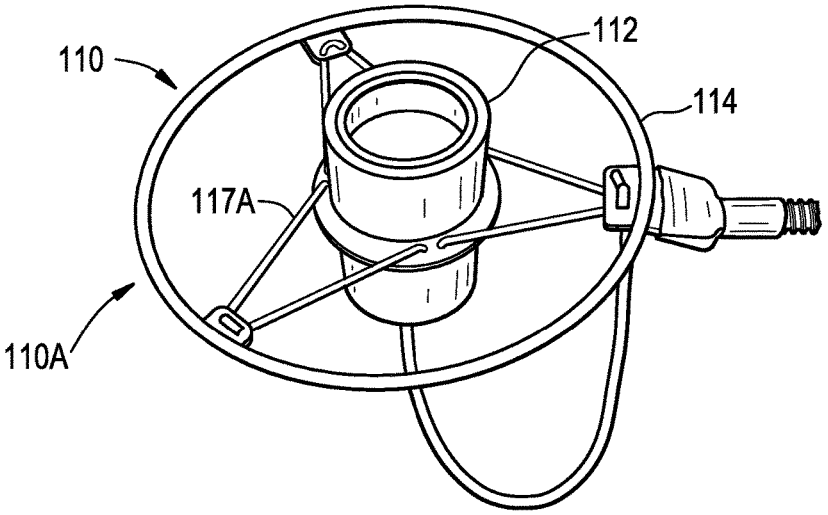
FIG. 6A is a detail image of one embodiment of an anti-shock microphone mountable on a wind or brass instrument in accordance with the present invention.
Figure 6B:
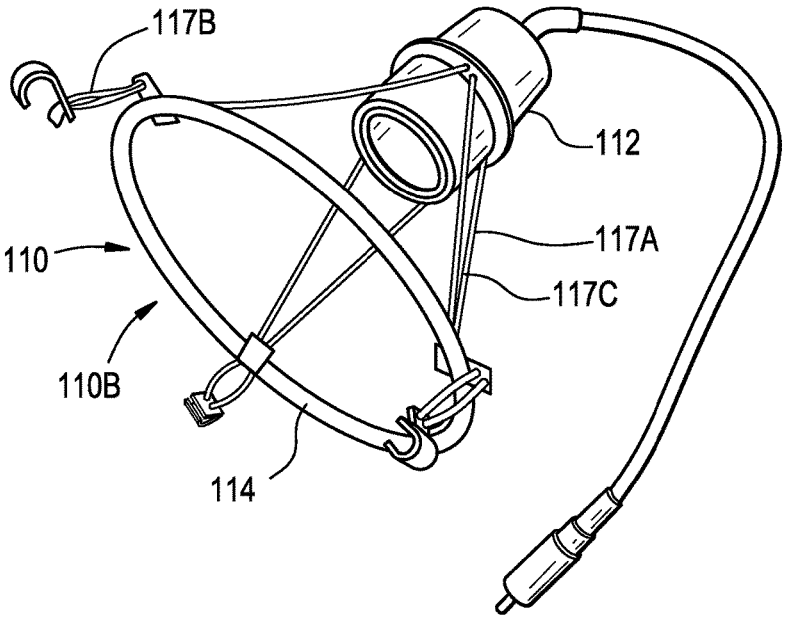
FIG. 6B is a detail image of another embodiment of an anti-shock microphone mountable on a wind or brass instrument in accordance with the present invention.

In one embodiment of the mounting basket 110 and as shown in FIG. 6A, the microphone 112, the mounting ring 114 and the filament 117A are disposed in the same plane and such a configuration is referred to herein as a flat basket 110A. In one embodiment, the first filament 117A and/or the second filament 117B is elastomeric. In one embodiment of the mounting basket 110 and as shown in FIG. 6B, the microphone 112 and the filament 117A are not disposed in the same plane as the mounting ring 114 and instead protract outwardly therefrom, and such a configuration is referred to herein as a protracted basket 110B. Optionally and as shown in FIG. 6B, the filament 117A is replaced with a plurality of hard or stiff filaments or wires 117C to fix the position of the microphone 112 with respect to the mounting ring 114.

Figure 7A:
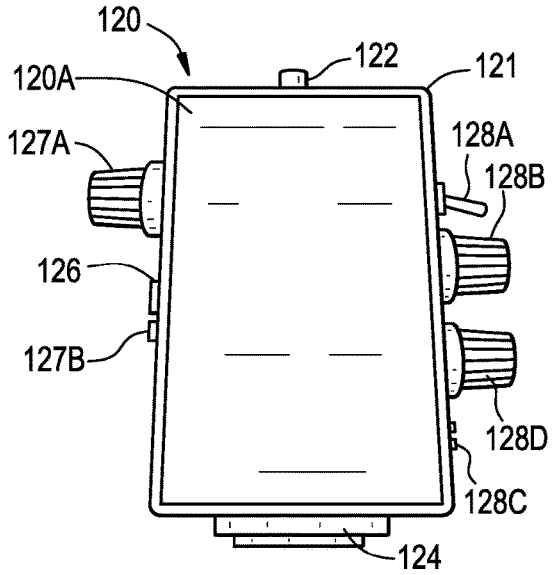
FIG. 7A is a top view of the front side of the self-powered monitor of FIG. 1.
Figure 7B:
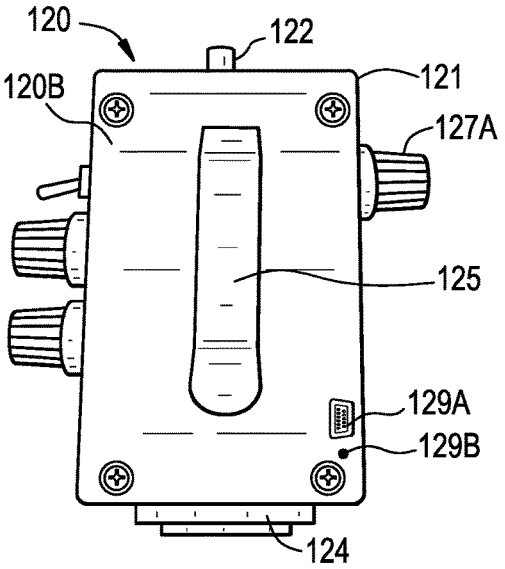
FIG. 7B is a top view of the back side of the self-powered monitor of FIG. 1.

The front side 120A and back side 120B of the personal monitor 120 of FIG. 1 are shown in FIGS. 7A and 7B. The personal monitor 120 includes a housing or case 121, an audio input port 122 such as for the microphone 112, and an audio output port 126 such as for an earphone or headphones. The personal monitor 120 further includes an earphone power switch and volume control or potentiometer 127A and an earphone power indicator 127B. The personal monitor 120 further includes a microphone impedance switch 128A, a microphone gain switch and adjustment control or potentiometer 128B, an auxiliary input port 128C, and an auxiliary trim switch and adjustment control or potentiometer 128C. The personal monitor 120 further includes a USB port 129A for charging a battery mounted within the housing 121, and a state-of charge indicator 129B indicating that the unit is or is not charging and if the unit is fully charged. The personal monitor 120 further includes a clip 125 fixedly attached to the housing 121 mountable to a musician's belt, an instrument or like gear. The personal monitor 120 includes an electrical and audio connection port 124 such as for an XLR electrical connector.

Figure 8A:
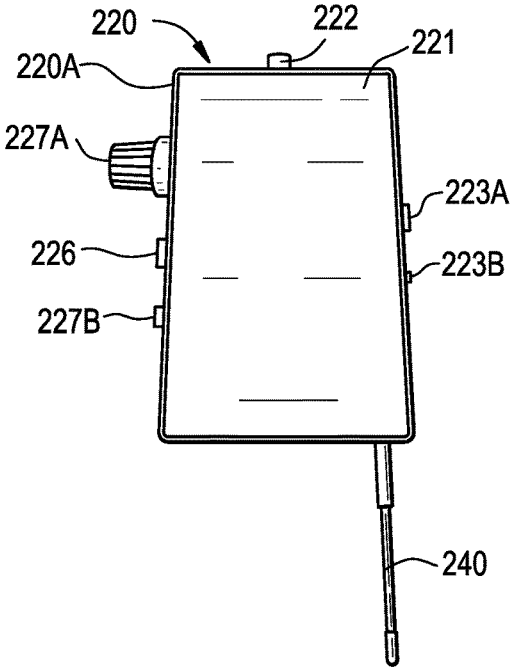
FIG. 8A is a top view of the front side of the self-powered monitor of FIG. 2.
Figure 8B:
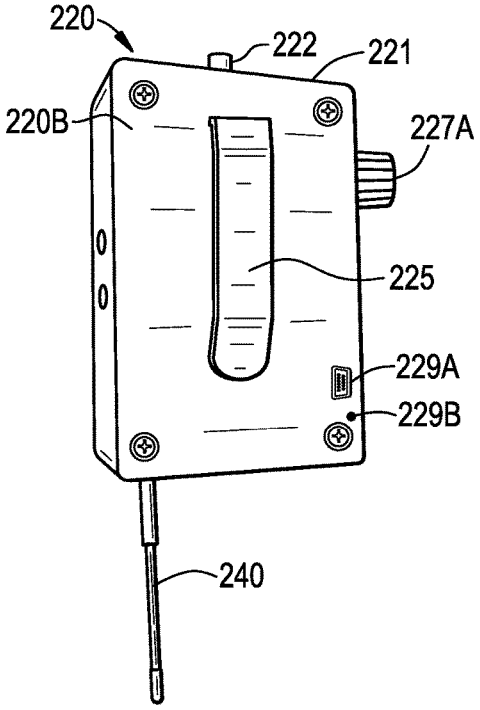
FIG. 8B is a top view of the back side of the self-powered monitor of FIG. 2.

The front side 220A and back side 220B of the personal monitor 220 of FIG. 2 are shown in FIGS. 8A and 8B. The personal monitor 220 includes a main power switch 223A and a main power indicator 223B. The personal monitor 220 includes a housing or case 221, an audio input port 222 such as for the microphone 212, and an audio output port 226 such as for an earphone or headphones. The personal monitor 220 further includes an earphone power switch and volume control 227A and an earphone power indicator 227B. The personal monitor 220 further includes a USB port 229 for charging a battery mounted within the housing 221 or for connecting the personal monitor 220 to a USB port of a computing device for recording and/or processing the sound picked up by the microphone 212 (FIG. 2). The personal monitor 220 further includes a state-of charge indicator 229B indicating that the unit is or is not charging and if the unit is fully charged. The personal monitor 220 further includes a transmitter (not shown) mounted within the housing 221 for transmitting a signal incorporating the sound picked up by the microphone to a soundboard, mixing board, or to a computing device for recording and/or processing the sound picked up by the microphone 212 (FIG. 2). An antenna 240 is mounted to the housing 221 and is connected to the transmitter (not shown) mounted within the housing 221. In one embodiment, the transmitter (not shown) mounted within the housing 221 is a transceiver that can both transmit and receive communications. A clip 225 is fixedly attached to the housing 221 and is mountable to a musician's belt, an instrument or like gear.

Figure 9:
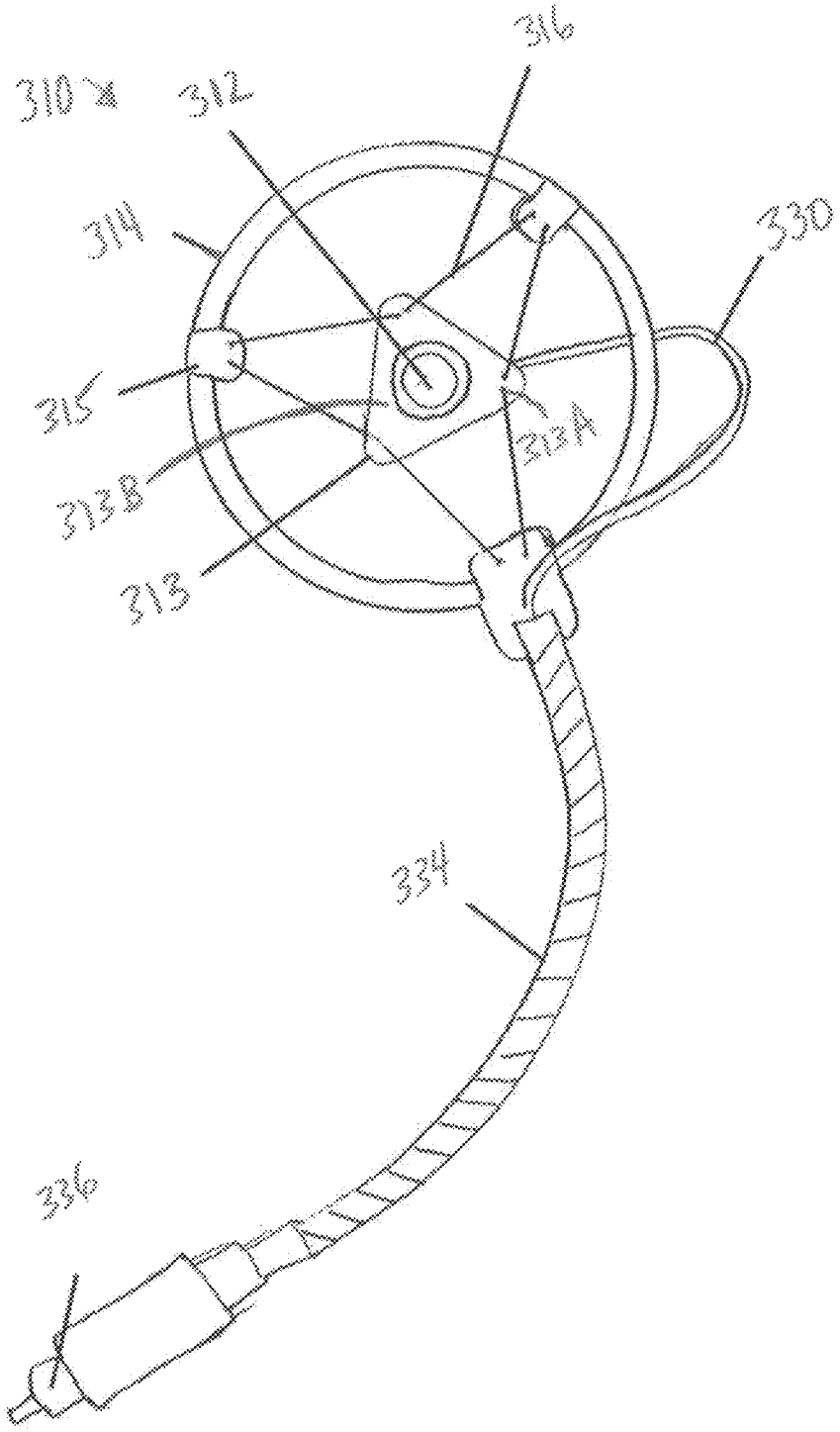
FIG. 9 is a top view of the anti-shock microphone of FIG. 6A.

In one embodiment and as shown in FIG. 9, one embodiment of a mounting basket 310 includes a microphone 312 disposed within a mounting ring 314 and secured thereto via one or more hanging filaments 316 that slidingly passes through one or more mounting ring couplings 315, for example three couplings 315, fixedly or slideably mountable to mounting ring 314. The filament 316 also slidingly passes through a microphone mount 313 at respective apertures or pairs of apertures 313A located between each pair of mounting ring couplings 315. In one embodiment, the microphone mount 313 forms a triangular configuration 313B wherein each pair of apertures 313A is advantageously located at respective points of the triangular configuration 313B. The microphone mount 313 is adaptable in size to accommodate a variety of microphones. A sound cable 330 connects the microphone 312 to a personal monitor (not shown) via a cable jack 336. In one embodiment and as shown in FIG. 9, the sound cable 330 is enclosed within a flexible gooseneck sheath 334.

Figure 12A:
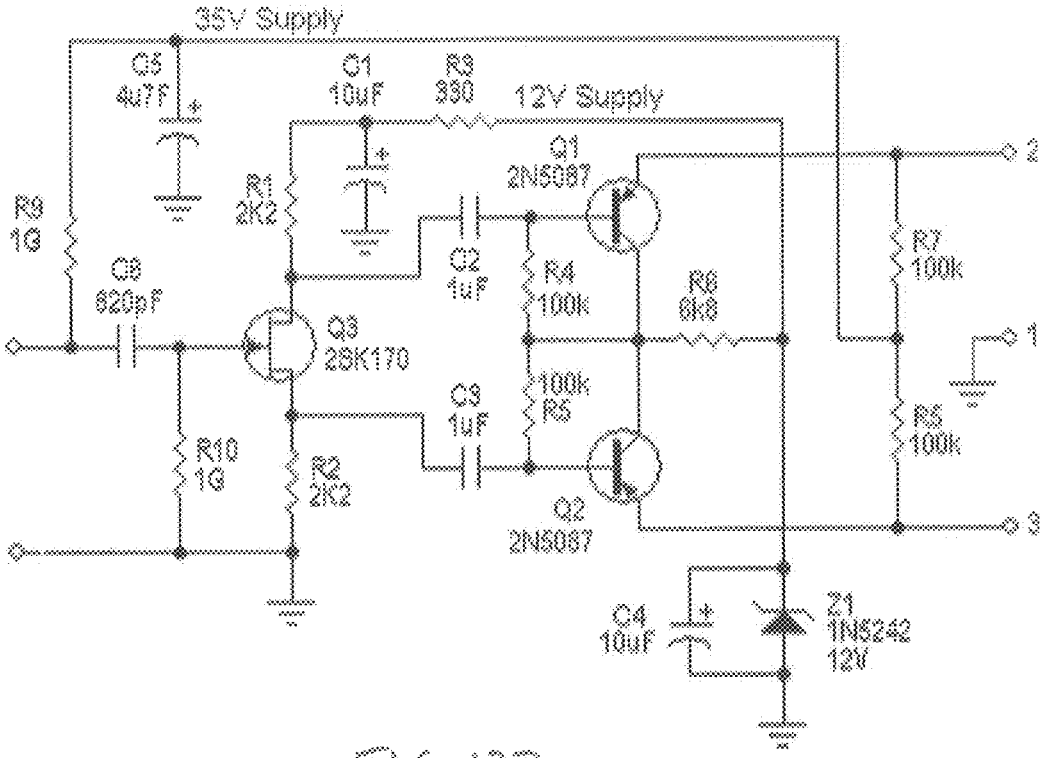
FIG. 12A is a schematic diagram of an exemplary design circuit for a microphone for use with the anti-shock self-powered microphone and monitor system of FIG. 1 or FIG. 2.
Figure 12B:
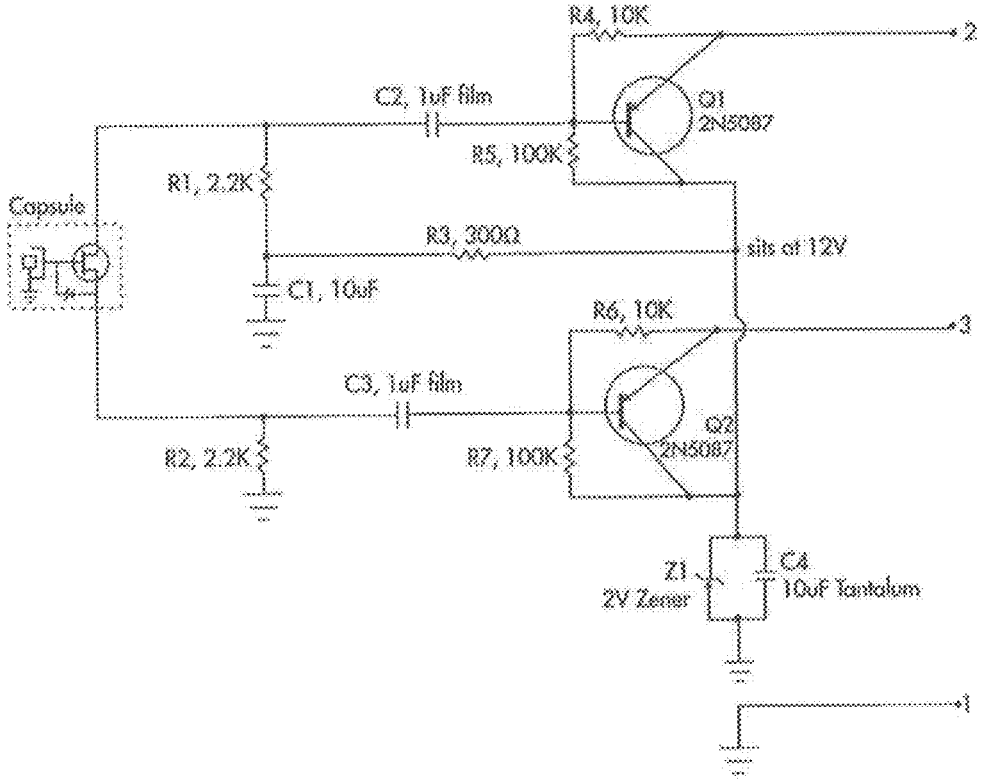
FIG. 12B is another schematic diagram of an exemplary design circuit for a microphone for use with the anti-shock self-powered microphone and monitor system of FIG. 1 or FIG. 2.
Figure 13:
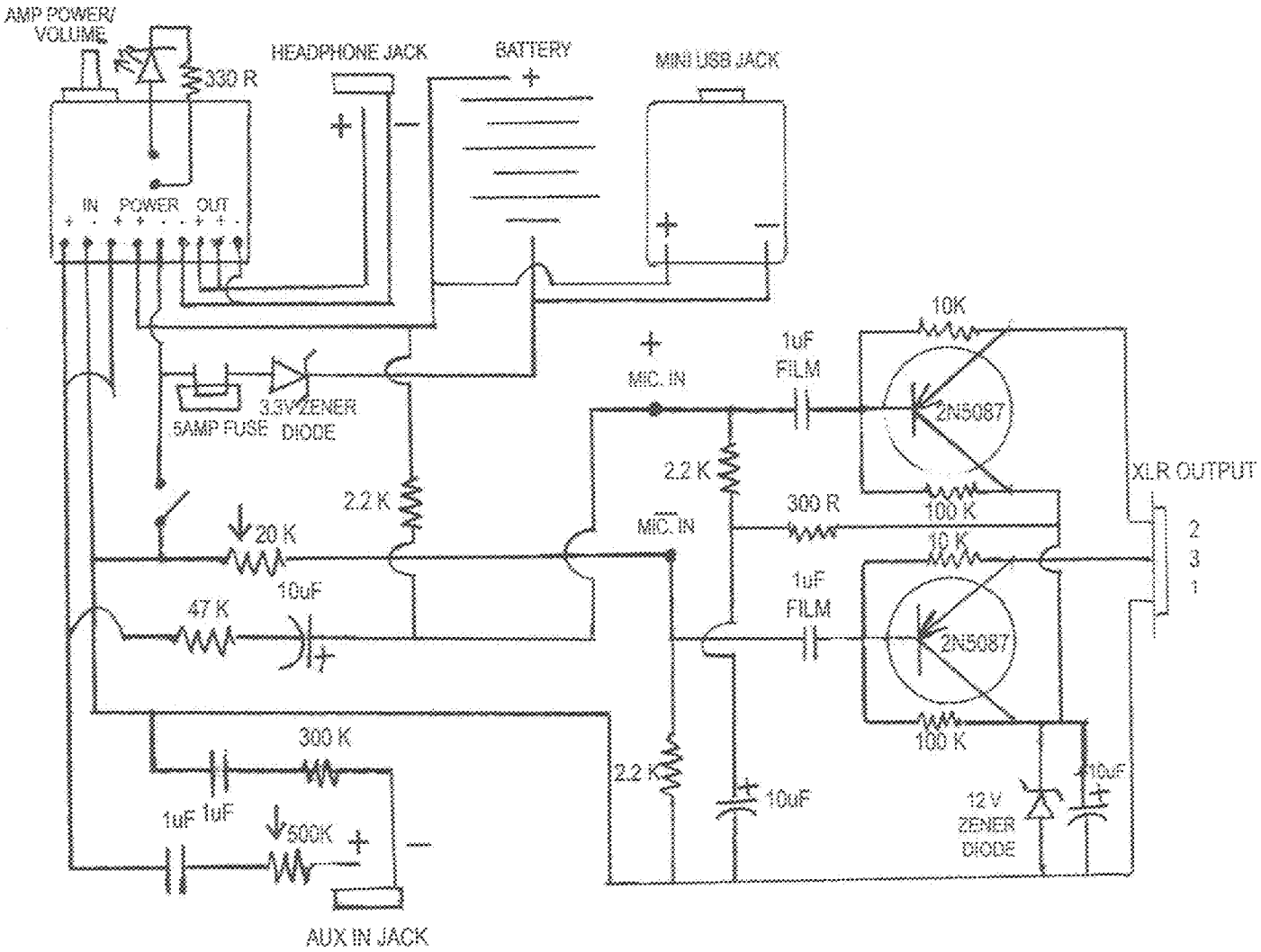
FIG. 13 is a schematic diagram of an exemplary embodiment of the self-powered monitor of the anti-shock self-powered microphone and monitor system of FIG. 1 or FIG. 2.

In one embodiment, the microphone 112 of FIG. 1 is a condenser microphone. In one embodiment, the microphone 112 of FIG. 1 is an electret microphone. The personal monitor 120 shown in FIGS. 7A and 7B provides the musician with an onboard switchable choice of two separate microphone circuits to accommodate the condenser and electret microphones. For example, a first high sound quality microphone circuit is powered by a standard 48V phantom power supply via the electrical connection port 124. Alternatively, an electret microphone circuit is powered by an onboard rechargeable battery such as for example a 3.7V lithium ion battery. Exemplary microphone design circuit schematics are presented in FIGS. 12A and 12B. An exemplary design schematic of the personal monitor 120 is presented in FIG. 13.

Although this invention has been shown and described with respect to the detailed embodiments thereof, it will be understood by those of skill in the art that various changes may be made and equivalents may be substituted for elements thereof without departing from the scope of the invention, and further that the features of the embodiments described herein can be employed in any combination with each other. Thus, the elements of each of the Figures disclosed herein and their descriptions thereof can be used in any combination with each other. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. An anti-shock self-powered microphone and monitor system for wind or brass instruments, the system comprising:

a mounting basket including a mounting ring;

a microphone, a portion of which defines a microphone mount, disposed within the mounting ring;

a personal monitor;

a cable extending between and connecting the mounting basket and the personal monitor;

at least one first filament fastening the microphone within the mounting ring, the at least one first filament engaging at least one mounting ring coupling attached to the mounting ring, the at least one first filament further engaging the microphone mount; and at least one second filament fastening the at least one mounting ring coupling to a corresponding at least one bell mounting coupling thereby providing for removeably attaching the system to a bell of a wind or brass instrument;

wherein the mounting ring defines a first plane and the microphone and the at least one first filament are disposed in the first plane.

2. The system of claim 1, wherein the mounting basket is adaptable in size to accommodate the attachment of the mounting basket to a bell of a plurality of brass or wind instruments.

3. The system of claim 1, wherein the at least one first filament is elastomeric.

4. The system of claim 1, wherein the personal monitor comprises;

a housing;

a first audio input port;

a first audio output port;

a first audio output power switch and volume control;

a first audio output power indicator;

a universal serial bus (USB) port for charging a battery mounted within the housing; and a state-of charge indicator.

5. The system of claim 4, wherein the personal monitor is configured as a hard-wired device, the personal monitor further comprising:

a microphone impedance switch;

a microphone gain switch and adjustment control; and an electrical and audio connection port.

6. The system of claim 4, wherein the personal monitor is configured as a wireless device, the personal monitor further comprising:

a transmitter mounted within the housing for transmitting a signal incorporating sounds picked up by the microphone to a soundboard, a mixing board, or to a computing device; and an antenna mounted to the housing.

7. The system of claim 4, wherein the personal monitor is connected, via the USB port, to a computing device for processing sounds picked up by the microphone.

8. An anti-shock self-powered microphone and monitor system for wind or brass instruments, the system comprising:

a mounting basket including a mounting ring;

a microphone, a portion of which defines a microphone mount, disposed within the mounting ring;

a personal monitor;

a cable extending between and connecting the mounting basket and the personal monitor;

at least one first filament fastening the microphone within the mounting ring, the at least one first filament engaging at least one mounting ring coupling attached to the mounting ring, the at least one first filament further engaging the microphone mount;

at least one second filament fastening the at least one mounting ring coupling to a corresponding at least one bell mounting coupling thereby providing for removeably attaching the system to a bell of a wind or brass instrument;

wherein the mounting ring defines a first plane and the microphone and the at least one first filament protract outwardly from the first plane; and wherein the at least one first filament comprises: a plurality of stiff filaments to fix the position of the microphone with respect to the mounting ring.

9. The system of claim 8, wherein the at least one second filament is elastomeric.

10. An anti-shock self-powered microphone and monitor system for wind or brass instruments, the system comprising:

a mounting basket including a mounting ring;

a microphone, a portion of which defines a microphone mount, disposed within the mounting ring;

a personal monitor configured as a hard-wired device, the personal monitor comprising, a first audio input port, a first audio output port, a first audio output power switch and volume control, a first audio output power indicator, a universal serial bus (USB) port for charging a battery mounted within the housing, a microphone impedance switch, a microphone gain switch and adjustment control, and an electrical and audio connection port;

a cable extending between and connecting the mounting basket and the personal monitor;

at least one first filament fastening the microphone within the mounting ring, the at least one first filament engaging at least one mounting ring coupling attached to the mounting ring, the at least one first filament further engaging the microphone mount;

at least one second filament fastening the at least one mounting ring coupling to a corresponding at least one bell mounting coupling thereby providing for removeably attaching the system to a bell of a wind or brass instrument;

wherein the mounting ring defines a first plane and the microphone and the at least one first filament protract outwardly from the first plane;

wherein the at least one first filament comprises: a plurality of stiff filaments to fix the position of the microphone with respect to the mounting ring; and wherein the mounting basket is adaptable in size to accommodate the attachment of the mounting basket to a bell of a plurality of brass or wind instruments.

11. An anti-shock self-powered microphone and monitor system for wind or brass instruments, the system comprising:

a mounting basket including a mounting ring;

a microphone, a portion of which defines a microphone mount, disposed within the mounting ring;

a personal monitor configured as a wireless device, the personal monitor comprising, a first audio input port, a first audio output port, a first audio output power switch and volume control, a first audio output power indicator, a universal serial bus (USB) port for charging a battery mounted within the housing, a transmitter mounted within the housing for transmitting a signal incorporating sounds picked up by the microphone to a soundboard, a mixing board, or to a computing device, and an antenna mounted to the housing;

a cable extending between and connecting the mounting basket and the personal monitor;

at least one first filament fastening the microphone within the mounting ring, the at least one first filament engaging at least one mounting ring coupling attached to the mounting ring, the at least one first filament further engaging the microphone mount;

at least one second filament fastening the at least one mounting ring coupling to a corresponding at least one bell mounting coupling thereby providing for removeably attaching the system to a bell of a wind or brass instrument;

wherein the mounting ring defines a first plane and the microphone and the at least one first filament protract outwardly from the first plane;

wherein the at least one first filament comprises: a plurality of stiff filaments to fix the position of the microphone with respect to the mounting ring; and wherein the mounting basket is adaptable in size to accommodate the attachment of the mounting basket to a bell of a plurality of brass or wind instruments.

* * * * *